United States Patent [19]

Welch et al.

[11] 3,999,372

[45] Dec. 28, 1976

[54] PARKING METER CONTROL UNIT

[75] Inventors: Lewis W. Welch, Los Angeles; Glenn E. Fish, Whittier; Edward L. Pollard, Costa Mesa, all of Calif.

[73] Assignee: Park Control, Inc., Los Angeles, Calif.

[22] Filed: Jan. 28, 1971

[21] Appl. No.: 110,564

Related U.S. Application Data

[63] Continuation-in-part of Ser. No. 793,937, Jan. 17, 1969, abandoned.

[52] U.S. Cl. ..... 58/142; 194/DIG. 21

[51] Int. Cl.[2] ..... G07C 1/30

[58] Field of Search ..... 194/1, 3, 6, 9, 11, 194/16, 17–20, 28, 32, 33, 45, 46, 54–56, 61, 62, 67, 69, 70, 72–74, 78, 83, 84, 95, DIG. 21, DIG. 22, DIG. 23, 1 A; 340/1, 3, 1 R; 58/142

[56] References Cited

UNITED STATES PATENTS

| | | | |
|---|---|---|---|
| 2,656,908 | 10/1953 | Ellison | 194/Dig. 21 |
| 2,807,016 | 9/1957 | Gloess | 340/1 R |
| 3,166,732 | 1/1965 | Ljungman et al. | 194/1 A |
| 3,535,870 | 10/1970 | Mitchell | 58/142 |

*Primary Examiner*—E. S. Jackmon
*Attorney, Agent, or Firm*—Keith D. Beecher

[57] ABSTRACT

The invention provides an equalizer or control unit to be used in conjunction with the present day type of parking meter. The control unit of the invention comprises an ultrasonic transmitter and receiver system which senses the presence of a parked vehicle, and which controls the parking meter in a manner such that the time remaining in the meter is returned to zero when the vehicle is driven away. The system to be described also controls the meter in a manner so as to prevent anyone from inserting coins into the meter after an initial parking interval has expired thereby to prevent the monopolization of the parking space by one vehicle over extended periods of time.

22 Claims, 25 Drawing Figures

Fig. 4
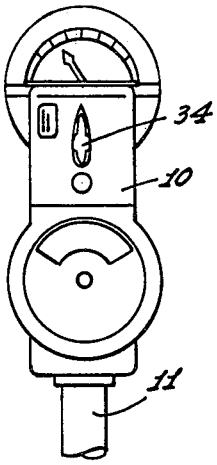
Fig. 5
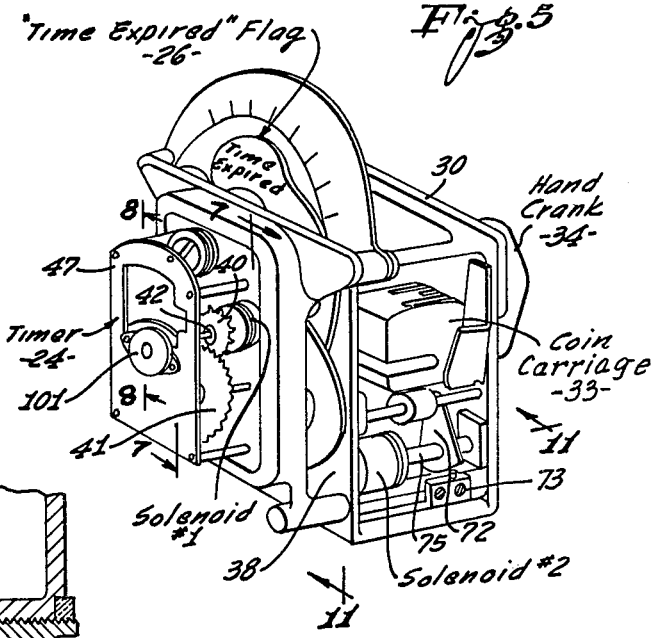
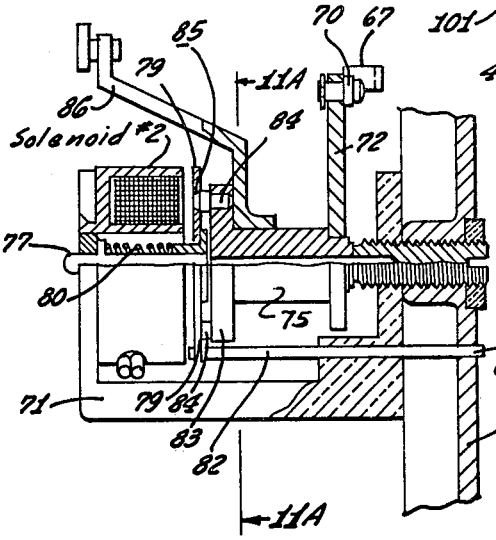
Fig. 11
Fig. 8
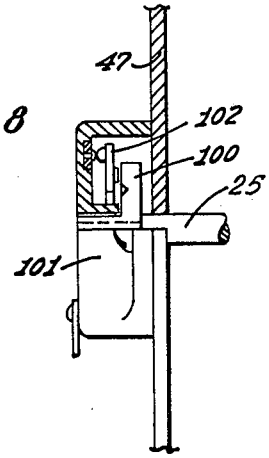
Fig. 7
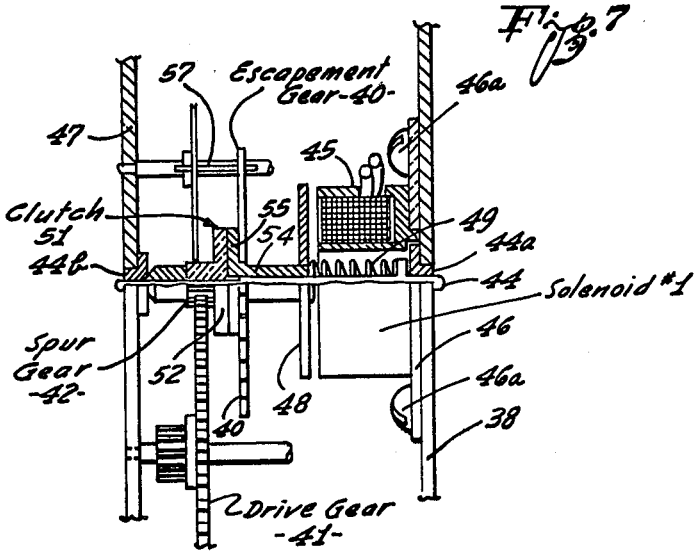

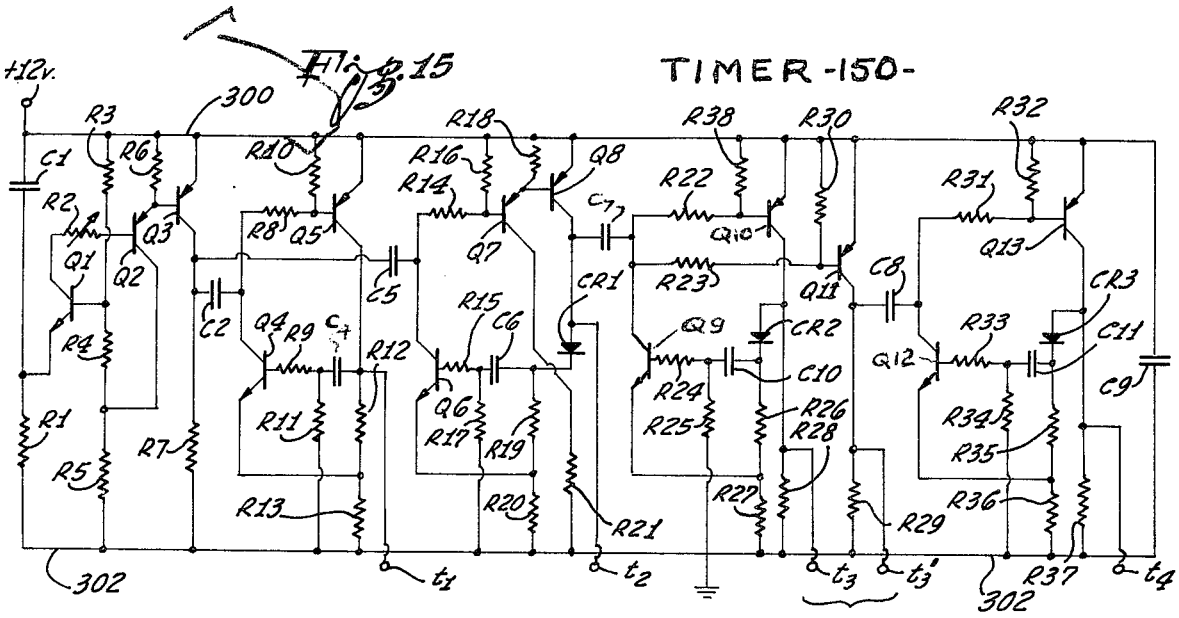
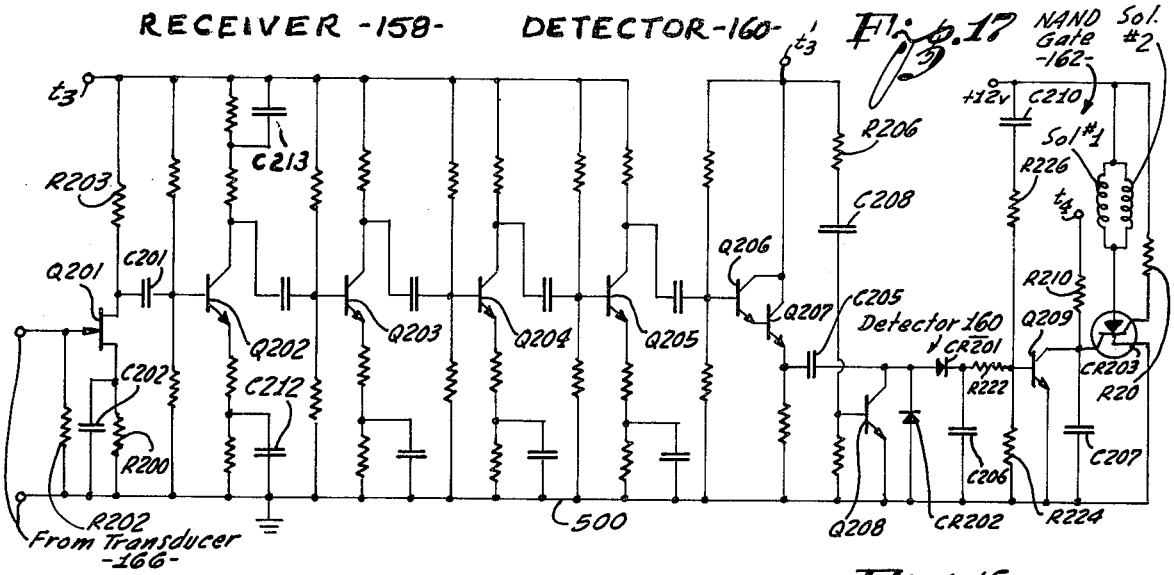
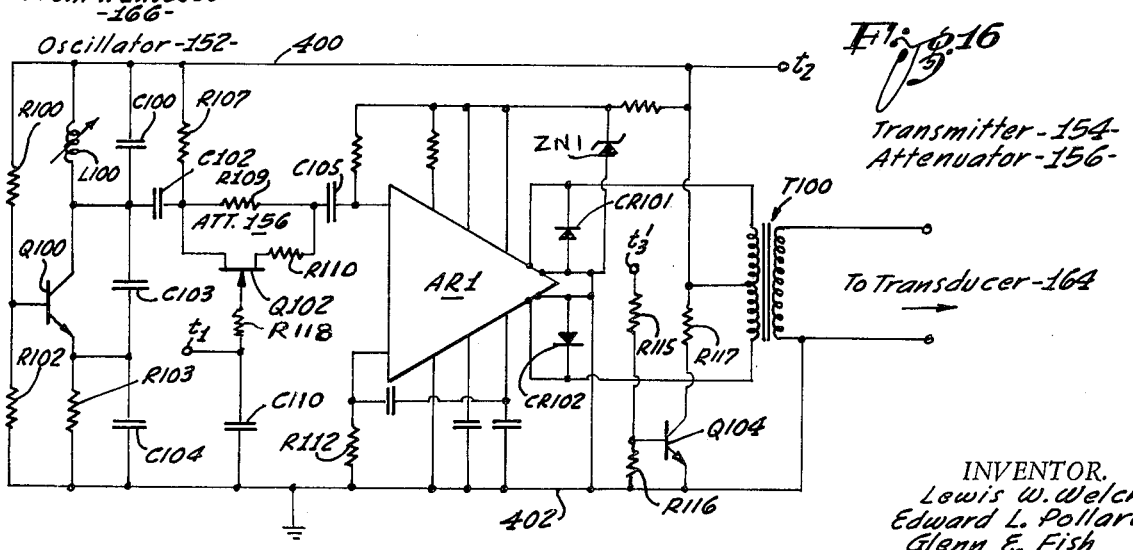
INVENTOR.
Lewis W. Welch
Edward L. Pollard
Glenn E. Fish
Jessup and Beuchel
By W T Jessup
ATTORNEYS INVENTORS:
Lewis W. Welch
Edward L. Pollard
Glenn E. Fish
Jessup and Beecher
By Warren T. Jessup
ATTORNEYS INVENTORS:
Lewis W. Welch
Edward L. Pollard
Glenn E. Fish
Jessup and Beecher
By Warren T. Jessup Fig. 21 (Timer-150)
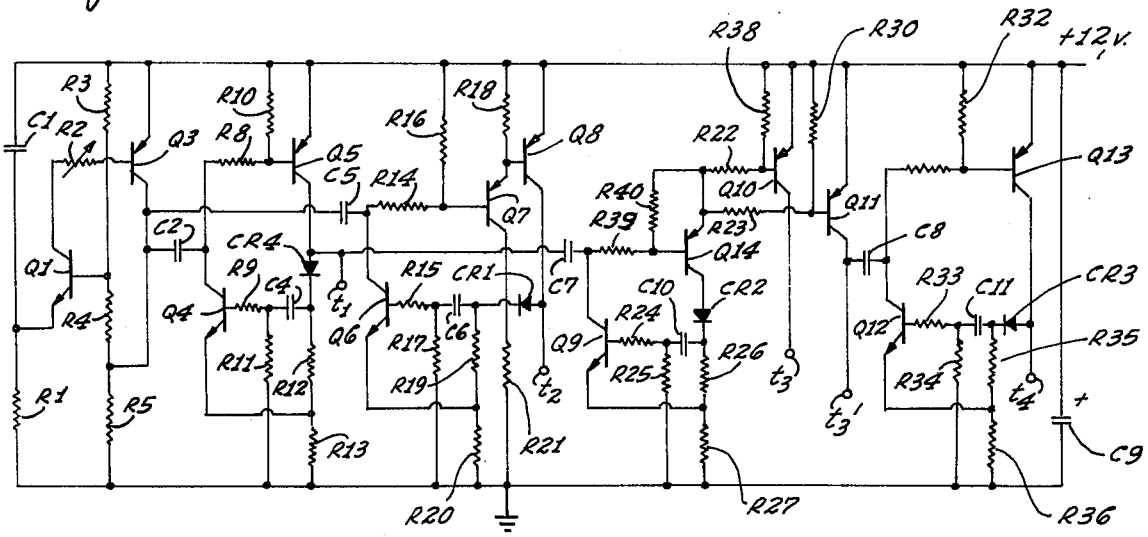
INVENTORS:
Lewis W. Welch
Edward L. Pollard
Glenn E. Fish
Jessup and Beecher
By Warren T. Jessup Fig. 23 (Receiver-158)
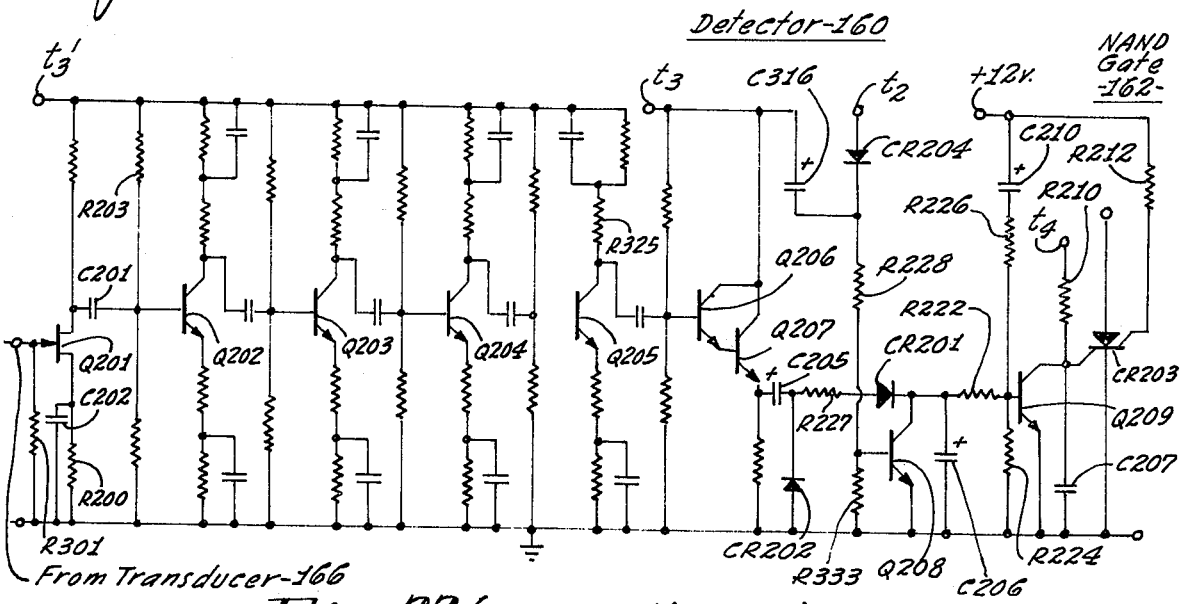
Fig. 22 (Transmitter-154)
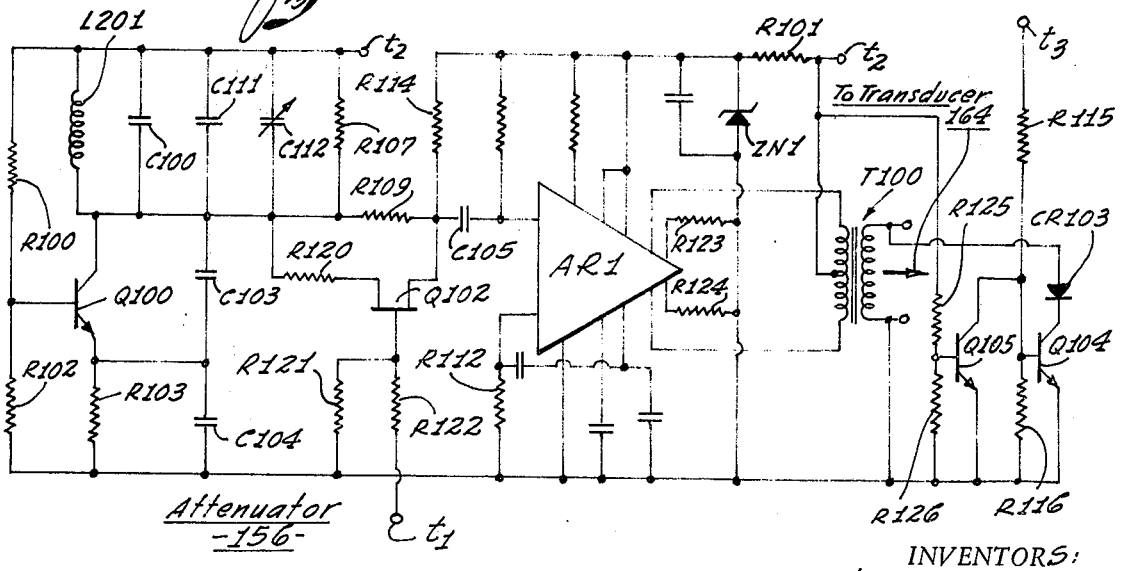
INVENTORS:
Lewis W. Welch
Edward L. Pollard
Glenn E. Fish
Jessup and Beecher
By Warren T. Jessup

PARKING METER CONTROL UNIT

RELATED PATENT APPLICATION

This application is a continuation-in-part of copending application Ser. No. 793,937 which was filed Jan. 17, 1976 in the names of the present inventors, now abandoned.

BACKGROUND OF THE INVENTION

As described above, the control unit or equalizer of the present invention is intended to be used with the usual type of parking meter for motor vehicle curb parking control. The system and apparatus of the invention controls the parking meter in a manner so as to require each parked vehicle independently to purchase parking time and to prevent multiple parking periods for any one vehicle.

Parking meters are ostensibly provided as a service to prevent monopolizing of curbside parking spaces by a few individuals to the detriment of the general public. It is well known that parking meters are effective to a degree, because anyone having an office at a remote location, or business which will take them into a store or office for some period of time, will seek out a parking facility of unlimited parking duration, rather than utilizing the metered curb spaces.

However, it is also true that some persons will renew the meter, so as to secure an additional time interval for their parked vehicle by depositing another coin, or coins, just before the previously purchased parking period has expired. This practice thwarts, at least to some extent, the purpose of the parking meter, which is to provide curbside parking for the general public for limited intervals, rather than to permit certain individuals to occupy the spaces over prolonged period.

One of the objects of the control unit to be described is to provide a control for the usual type of curbside parking meter, the control being capable of detecting the presence of a vehicle, and of responding to the presence of the vehicle, to block the coin receiving portion of the meter from accepting further coins, after the initial coin or coins have been deposited, until the vehicle has been moved from the parking space. Although the control unit to be described is such that the vehicle need be out of the parking space only for a brief interval, nevertheless, sufficient inconvenience and nuisance to the owner is provided, so that a deterrent is created against any one person monopolizing a curb space.

Although parking meters were originally intended as an accommodation to prevent the monopolization of parking spaces at curbside, the meters have proven to be a financial benefit to most cities, and the revenue obtained is usually substantial, and a welcome addition to the city income. It is considered a loss, therefore, to permit a subsequent motorist to utilize the parking time purchased by another, merely because the previous motorist has left the parking space before his time has expired.

It is evident that the city would obtain more revenue if residual parking time were eliminated from the meter when the original vehicle departs. Another object of the control unit of the present invention, therefore, it is provided an appropriate control which will cause the meter to vacate the residual time which is still unexpired, and return to zero, when the original vehicle is removed.

It is to be understood, of course, that it is contemplated that the control unit of the invention may be constructed to incorporate either the residual time vacating control, or the coin blocking control, or both, as desired.

BRIEF DESCRIPTION OF THE DRAWINGS

FIG. 4 is a rear elevational view of the meter of FIG. 1, turned 90° with respect to the view of FIG. 1, and as seen from the manual control side which is normally directed toward the offstreet side of the curb on which the assembly is mounted;

FIG. 5 is a perspective view of the internal operational components of the meter of FIG. 4;

FIG. 7 is a section of the unit of FIG. 5 taken along the line 7—7 of FIG. 5;

FIG. 8 is a section of the unit of FIG. 5 taken substantially along the line 8—8 of FIG. 5, both FIGS. 7 and 8 being sections of a clock or timer mechanism associated with the unit of FIG. 5;

FIG. 11 is a section taken along the line 11—11 of FIG. 5;

FIGS. 15–17 are circuit diagrams of the electrical control system shown in block form in FIG. 12;

FIGS. 21–23 are circuit diagrams like the circuit diagrams of FIGS. 15–17 but modified in some respects.

DETAILED DESCRIPTION OF THE ILLUSTRATED EMBODIMENTS

Figure 1:
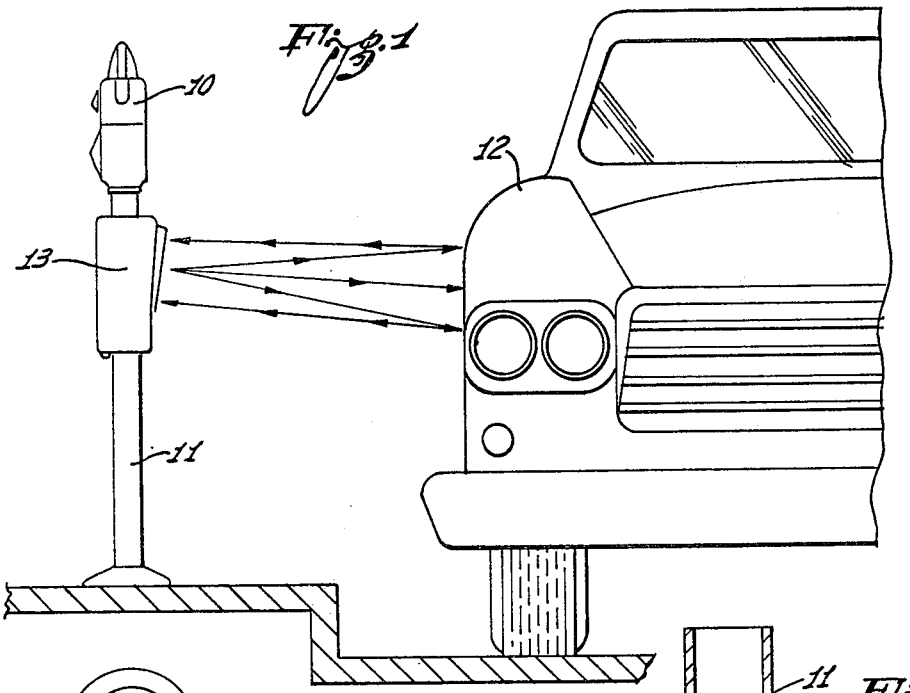
FIG. 1 is a side elevational view of a parking meter, with a control unit embodying the features of the present invention mounted in the supporting standard of the meter.
Figure 2:
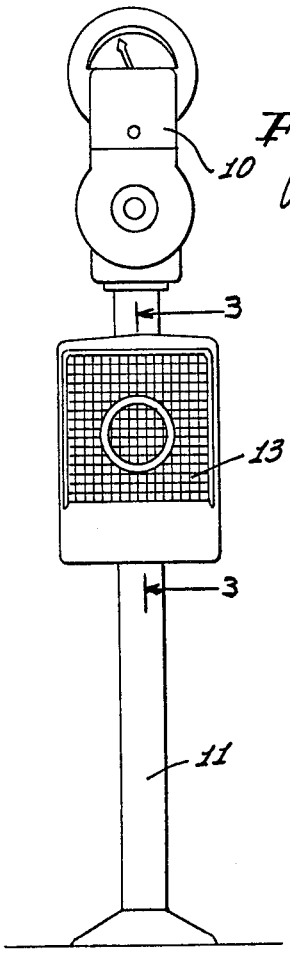
FIG. 2 is a front elevational view of the parking meter and control unit of FIG. 1, turned 90° with respect to the view of FIG. 1, as seen from the street side of the curb.

FIG. 1 illustrates a parking meter 10 which is mounted on a post or standard 11, in the most usual and conventional position along a street curb. The external appearance of the meter, as shown in FIG. 1, is conventional except for a housing in which the control unit 13 of the present invention is mounted, and which is positioned partially down the post 11 from the meter 10. The control unit 13 includes an ultrasonic transmitter 16 and receiver 15 (FIG. 3), together with a circuit board 18 on which the control circuitry of the unit is mounted, and an energizing battery 19. The control circuitry, as will be described, actuates a pair of solenoids No. 1 and No. 2 shown, for example, in FIGS. 5, 7 and 11.

The parking meter itself, as shown in FIGS. 4 and 5, may be of a usual known and available type, except as modified for the purposes of the present invention. The meter mechanism, as shown in FIG. 5, has a front wall 30 and a rear wall 38. A timer 24 for the meter is mounted on a shaft 25 journalled on the rear wall 38; and a flag and pointer group 26 and a coin-controlled winding mechanism 28 (FIG. 6), are mounted between the walls 30 and 38 of FIG. 5. A coin acceptor 31 is also mounted between the walls 30 and 38, and adjacent the wall 30, and a plurality of different sized coin slots are provided in the coin acceptor. Generally there will be slots for at least two, and usually three denominations of coins in the acceptor 31.

A coin carriage 33 (FIGS. 9 and 10) is also mounted between the walls 30 and 38. The coin carriage has a starting position directly behind the wall 30 in which it may receive the coins inserted through the coin slots in the acceptor 31. A hand crank or handle 34 is employed to rotate the carriage 33. In the head of the carriage 33, there is placed a pawl structure which is driven by the coaction of coins placed in the carriage 33, and an adjacent cam which is not illustrated, this being a standard and known meter structure. As the handle 34 is turned to swing the carriage 33, the coin carried by the carriage 33 is caused to engage the cam surface and actuate the pawl structure according to the size and denomination of the coin.

Figure 6:
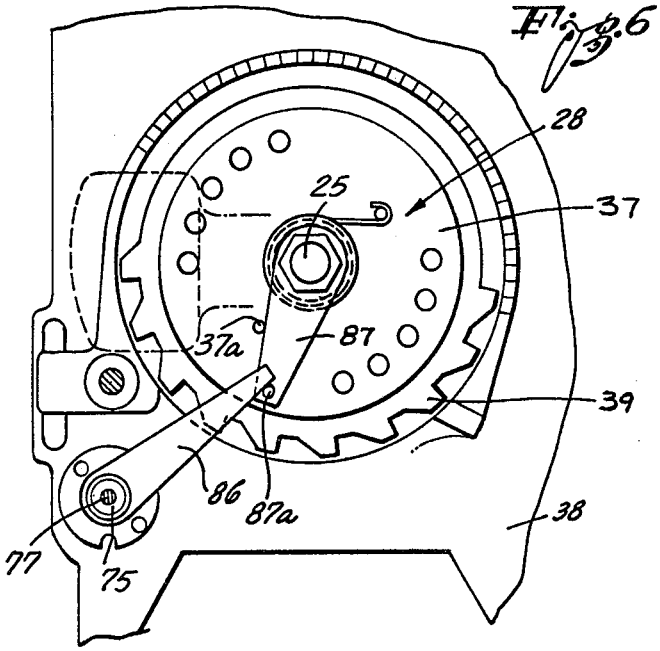
FIG. 6 is a view of the inner side of the left-hand wall of the unit of FIG. 5 as seen from the right of that wall and looking to the left.

The coin carriage 33 is then used to contact and turn a winding ring 37 secured to the timer shaft 25, as shown in FIG. 6. As stated above, FIG. 6 is a view of the wall 38 of FIG. 5, as viewed from the right of FIG. 5, and freed of the obstruction normally created by the wall 30, the carriage 33, and the associated mechanism. The winding ring 37 is provided with peripheral teeth 39, as shown in FIG. 6. Therefore, and in accordance with usual practice, as the carriage 33 is swung about its pivot point and has the pawl mechanism thereof actuated outwardly, as the handle 34 is turned after a coin has been inserted, the pawl mechanism will contact a particular tooth in the series of the teeth 39 of FIG. 6, and will cause the winding ring 37 to turn with the carriage from that point of contact.

For example, if a nickel is placed in its slot in the coin acceptor 31, the pawl mechanism of carriage 33 will be caused to pick up one of the first of the teeth 39 and, hence, will produce a partial rotation of the winding ring 37. If a dime is placed in its slot in the coin acceptor 31, the pawl mechanism will be caused to pick up a tooth 39 further along the winding ring 37, and hence, will cause additional rotation. In a similar manner, when a quarter, for example, is placed in its slot in the coin acceptor 31, full rotation of the ring 37 will be caused. The winding ring 37 is equipped with an overriding lever mechanism, which is adjusted to cause a coin obstructing shield 62, as will be described, to move over the coin slots after a first, or a second, coin is inserted in the carriage 33.

By means of the mechanism described above, the motorist may choose the amount of parking time desired to be purchased. The winding ring 37 is part of the main spring of the timer 24, which is substantially identical to the main spring of a clock mechanism. The main spring operates a gear train in the timer, which is controlled in its speed of run down by means of a usual escapement mechanism, to be described in somewhat more detail subsequently.

Normally, when a motorist purchases a period of time on the meter, and then does not keep his vehicle 12 parked for the full period of time purchased, the prior art meter continues to operate to its natural termination and, therefore, another motorist may add the remaining period of time to the amount he purchases for a longer complete parking period, or he may actually park for a sort period of time without placing any money in the meter by using the former motorist's remaining time. This, as mentioned above, represents a loss of revenue to the city, and one of the objects of the invention is to provide means for eliminating any unexpired period of time after the original purchasing motorist removes his vehicle from the parking space adjacent the meter.

The aforesaid objective is accomplished by use of a control in the escapement mechanism of the timer 24, and as best shown in FIG. 7. In FIG.7, for example, as escapement gear train is indicated, in part, by a gear 40 which operates under drive from a gear 41. The gear 41 is driven by the main spring (not shown) of the timer, which is wound by the winding ring 37 of FIG. 6. The gears 40 and 41 are interconnected by a spur gear 42. Thus, as in an ordinary clock mechanism, the wound main spring tends to drive the gear 41. Where there is no restraint on the operation of the gear 41, the gear would move at a fast rate of speed and the main spring would reach its fully unwound, relaxed state in a brief moment. However, the escapement mechanism provides a restraint on the gear 41 and causes the timed release of the main spring. The control unit of the present invention exerts a control on the escapement mechanism which removes the restraint when the vehicle 12 is moved from the parking space, so that the main spring becomes fully unwound in a brief moment.

To accomplish the aforesaid controlled release of the main spring by the control unit, a shaft 44 is carried in a bearing 44a in the wall 38, and this shaft extends within a core 45 which forms part of the solenoid No. 1. The bearing **44*a* and core 45 are mounted in a rigid base 46 which, in turn, is secured to the wall 38, for example, by screws 46*a*. The shaft 44 is also supported in a bearing 44*b* in a wall 47. The wall 47 forms the outer wall of the timer 24, as also shown in FIG. 5. The shaft 44, therefore, is supported in a predetermined alignment between the walls 38 and 47. The solenoid No. 1 also includes an armature 48 adjacent the core 45**, and which is biased to an extended position to the left in FIG. 7 and out of the core by means of a coil spring 49, so long as the solenoid No. 1 is de-energized.

A clutch 51 is composed of a clutch plate 52 mounted on the spur gear 42, and by a further clutch plate 55 operated by the solenoid No. 1. A bearing 54 is fitted to slide on the shaft 44, and this bearing carries the clutch plate 55. The spring 49 normally urges the clutch plate 55 into frictional contact with the clutch plate 52. When that occurs, the drive gear 41 is coupled to the escapement gear 40. The escapement gear 40 is restrained by a pin 57 in an escapement rocker, and so long as the clutch 51 is engaged, the escapement gear 40, the pin 57 causes the drive gear 41 to turn slowly and over a predetermined timed interval. However, when the solenoid No. 1 is energized, the clutch 51 is disengaged, so that there is no restraint on the drive gear 41, and the gear turns rapidly and the main spring of the timer quickly runs down.

From the preceding description, it will be seen that the clutch 51 is a connecting link between the escapement mechanism of the timer 24 and the gear train of the flag and pointer group 26. Thus, the escapement mehanism normally holds the drive gear 41 to a regularly timed discharge cycle. However, as explained above, upon the energizing of the solenoid No. 1, the restraint is taken from the drive gear 41. When that occurs, the main spring will exhaust its remaining energy in a moment of time so as to bring the timed cycle to an abrupt termination.

The mechanism in the flag and pointer group 26 then operates in the usual manner to remove the pointer of group 26 from the scale and to raise the flag which shows that the time has expired. Therefore, when an electrical signal is supplied to the energizing winding of the solenoid No. 1. of sufficient strength to operate the solenoid, the purchased time cycle of the meter will be brought to an end, so as to require the insertion of additional coins and a rewinding of the mechanism in order to initiate the next parking cycle.

As mentioned above, the control unit of the present invention also actuates a coin blocking mechanism, in order to prevent a motorist from returning to the meter and depositing additional coins, so as to extend his period of use. Since one of the purposes of parking meters, as mentioned above, is to prevent the monopolization of one parking space by any one vehicle for more than a given time period, such monopolization is prevented by the control unit of the invention in a manner now to be described.

Figure 9:
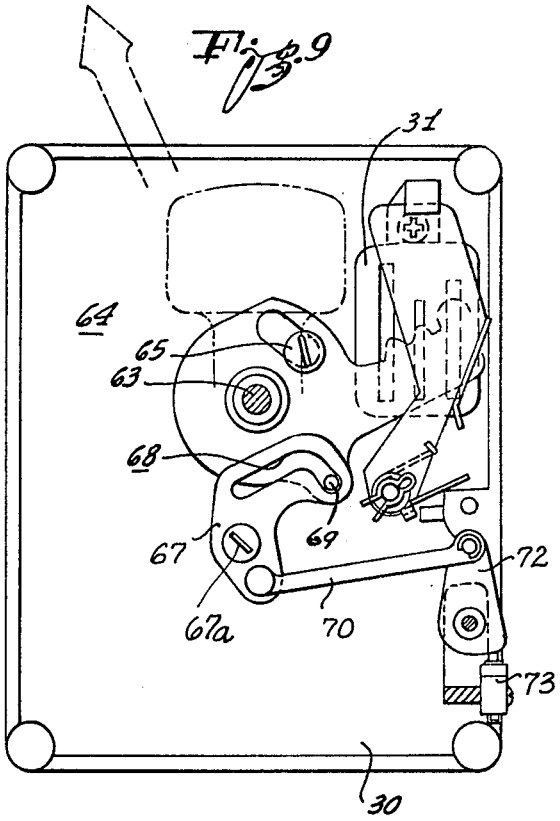
FIG. 9 is a view of the unit of FIG. 5 looking towards the inner side of the right-hand wall of the mechanism, and showing the mechanism in a coin blocking position.
Figure 10:
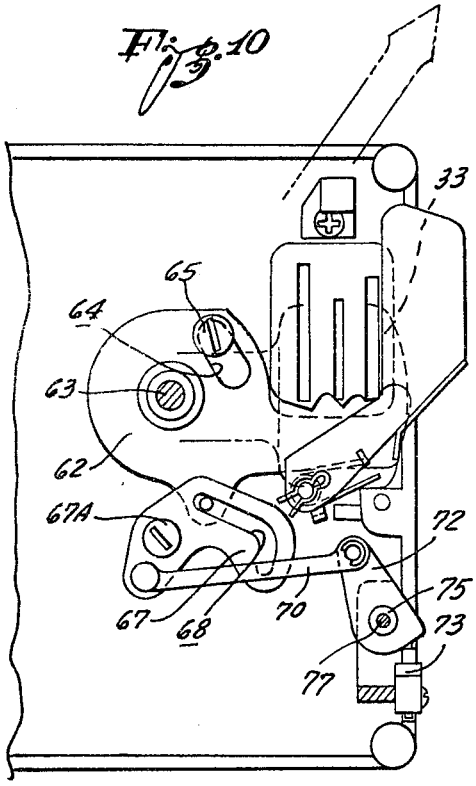
FIG. 10 is a view like FIG. 9, but with the mechanism in a coin accepting position.

The coin blocking mechanism, as controlled by the control unit of the invention is best shown in FIGS. 6, 9, 10, 11 and 11A. The shield 62 shown in FIGS. 9 and 10 has a coin blocking position with respect to the coin slots in the coin acceptor 31, as shown in FIG. 9, which it assumes when a coin is placed in the coin acceptor 31, and the hand crank 34 is turned to wind the parking meter to its set condition; and the shield assumes a coin admitting position with respect thereto as shown in FIG. 10 when the parking meter is returned to its standby condition. The shield 62 is carried by a hub 63. .A linkage member 67 is pivotally carried by a pin 67*a* on the wall 30 (FIG. 9), and the member 67 has an irregular slot 68 formed in it. A pin 69 carried by the shield 62 extends into the slot 68. The pin 69 travels in the slot 68 to control the position of the shield 62 from the coin blocking position of FIG. 9 to the coin accepting position of FIG. 10. The linkage is such that when the shield 62 is in the coin blocking position of FIG. 9, the pin 69 is positioned at one end of the slot 68, as shown in FIG. 9, with its tangential force in essential alignment with the pivot point 67*a* so that there is no camming force from 69 to the slot 68 and thus any rotation of the shield 62 is prevented, and the shield 62 is locked in the position of FIG. 9.

The aforesaid locking of the shield 62 in its coin blocking position prevents anyone from inserting a tool into the meter and moving the shield 62, so as to permit additional coins to be inserted in the slots of the coin acceptor 31. The shield 62 can be moved only when the member 67 is turned about its pivot point 67a from the locked position of FIG. 9 to the position of FIG. 10. The turning of the member 67 is controlled by a link 70 which is pivotally mounted on the opposite end of the member 67 from the slot 68. The link 70 extends to a drive arm 72. The arm 72 is mounted on a hub 75 (FIG. 5) associated with the solenoid No. 2 so as to pivot therewith. The arm 72 closes a switch 73 when the parking meter is wound to its set position, as shown in FIG. 9. However, the spring-loaded plunger of switch 73 engages an edge of the drive arm 72, so as to drive the complete linkage to the coin-admitting position of FIG. 10 when the arm is released.

As best shown in FIG. 11, the hub 75 is rotatably mounted on a shaft 77 which, in turn, is mounted in a bracket 71, the bracket being supported on the wall 30. The solenoid No. 2 is mounted coaxially with the shaft 77, and it includes an armature 79 which is normally biased to the right in FIG. 11 by means, for example, of a spring 80. However, when the solenoid 2 is energized, its armature 79 is drawn to the left in FIG. 11 and into the core structure against the biasing action of the spring 80. The solenoid No. 2 when in its de-energized stae serves to hold the arm 72 in the angular position shown in FIG. 9 which holds the switch 73 closed. However, when the solenoid No. 2 is energized, the arm 72 is released, and is turned to the position shown in FIG. 10 by the spring-biased plunger of the switch 73 and the switch 73 opens.

Figure 11A:
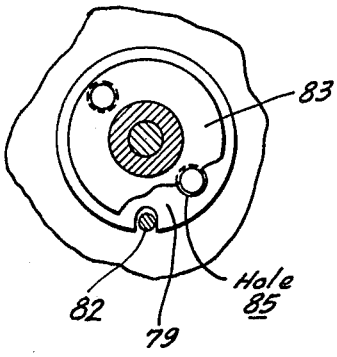
FIG. 11A is a further section taken along the line **11*a*—11*a* of FIG. 11**.

As shown in FIG. 11A, for example, the armature 79 has a peripheral notch which extends over a guide pin 82. The guide pin 82 is mounted in the wall 30 and in the bracket 71, as shown, in a stationary position, and it permits the armature 79 to move reciprocally to the left and right in FIG. 11, but it prevents rotation of the armature. The hub 75 has a flange 83 at its end adjacent the armature 79, and one or more pins 84 are carried by the flange 83, two of such pins being shown in FIGS. 11 and 11A. The armature 79 has corresponding holes 85 positioned such that the pins 84 will drop into the holes 85 when the hub 75 is rotated to align the pins with the corresponding holes.

As explained above, the spring-loaded plunger of the switch 73 returns the coin-blocking shield 62 to the position shown in FIG. 10 when the mechanism is released. However, when the mechanism is in its unreleased position, with the pins 84 extending into the corresponding holes 85, the shield 62 is held in the position shown in FIG. 9. That is, when the solenoid No. 2 is de-energized, and when the pins 84 are retained in the corresponding holes 85, the shield 62 is locked in its coin-blocking position of FIG. 9 and switch 73 is closed. However, when the solenoid No. 2 is energized, the armature 79 is moved to the left in FIG. 11 to free the pins 84 from the corresponding hole 85, and thereby release the hub 75, so that the spring-loaded plunger of the switch 73 may turn the arm 72 and cause the shield 62 to assume the unblocking position of FIG. 10 and the switch 73 is opened.

In order to place the shield 62 in the coin-blocking position of FIG. 9, an arm 86 in FIG. 11 engages a pin 87*a* at the end of a spring-loaded arm 87 on the ring 37 of FIG. 6. Therefore, when the mechanism is in the condition of FIG. 10, and a coin is placed in the corresponding slot of the coinacceptor 31, and when the handle 34 is turned to wind up the meter, the turning of the ring 37 causes the stop 37*a* on the ring to release the arm 87. This causes the pin 87*a* on the arm 87 to move the arm 86 so as to turn the hub 75 to a position in which the pins 84 are aligned with the holes 85, so that the armature 79 snaps forward to the right in FIG. 11 so as to hold the shield 62 in the position of FIG. 9 covering the coin slots. The hub 75 is then held against further rotation, until the solenoid No. 2 is energized to release it, as described above, thereby opening the coin slots. The shield 62 may be shaped; or the stop 37*a*, and pins 84 and holes 85, may be positioned so that the nickel coin slot is not blocked by insertion of the first coin, if so desired.

The actuating mechanism of the spring-loaded arm 87 and arm 86 is such that the mechanism is not damaged if vandals should insert a tool into the meter to prevent closure of the shield 62 and then turn the handle 34. All that happens is that the jammed arm 86 merely causes the arm 87 to turn back on its spring as the ring 37 is turned.

Figure 12:
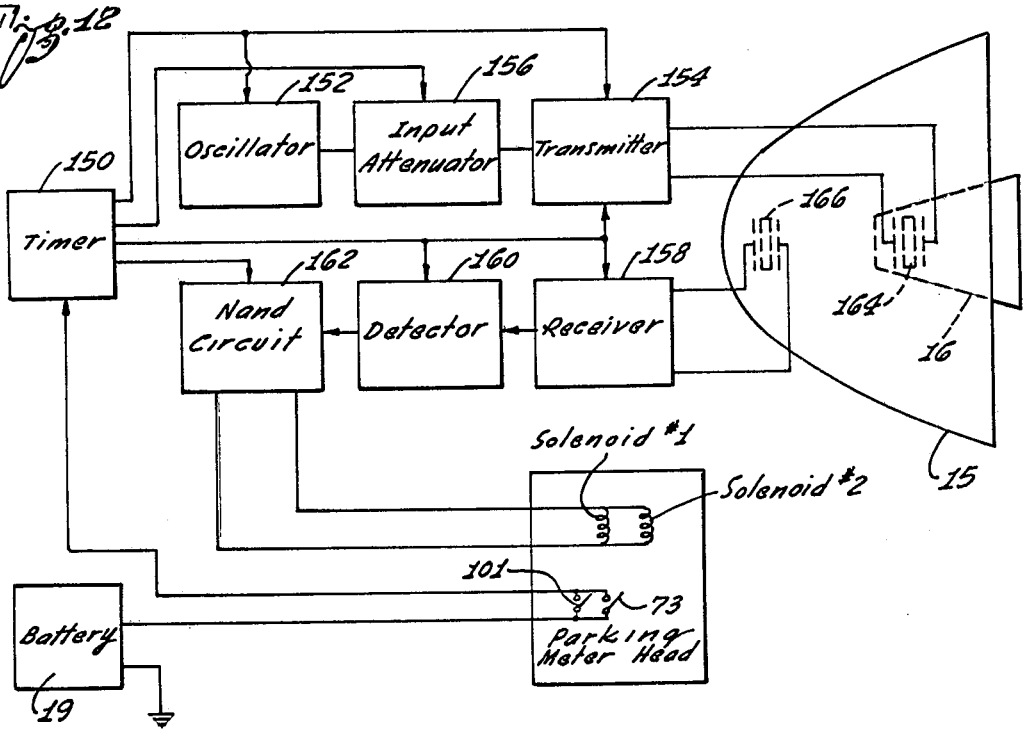
FIG. 12 is a block diagram of an electrical control system which may be included in the unit to be described.

As shown in FIG. 8, a switch 101 is mounted on the wall 47 and this switch closes, with the switch 73, when the hand crank 34 is operated to wind the parking meter to the set condition of FIG. 9. The switch includes a trip arm 100 which is keyed to the timer shaft 25 or to a shaft geared to the timer shaft 25. This trip arm normally holds the contact arm 102 of the switch 101 in a closed position when the parking meter is set. However, when the timer shaft 25 rotates to a fully unwound time-end position, the contact arm 102 opens the switch 101. The switch 101 and the switch 73 are included in the power lead for the control unit, as shown in FIG. 12 so that no power is consumed by the control unit until the meter is actually wound to a new time interval position shown in FIG. 9 the switch 73 opens when solenoid No. 2 is energized by the control unit to reset the parking meter; whereas the switch 101 opens at the end of the normal time interval. The switch 73 remains closed, however, until the vehicle is actually removed, as will be explained. The use of the switches 73 and 101 assures that there will be no power wasted, and that the control unit will assuredly be turned off, until the meter is actually wound and set to a new time interval.

Figure 3:
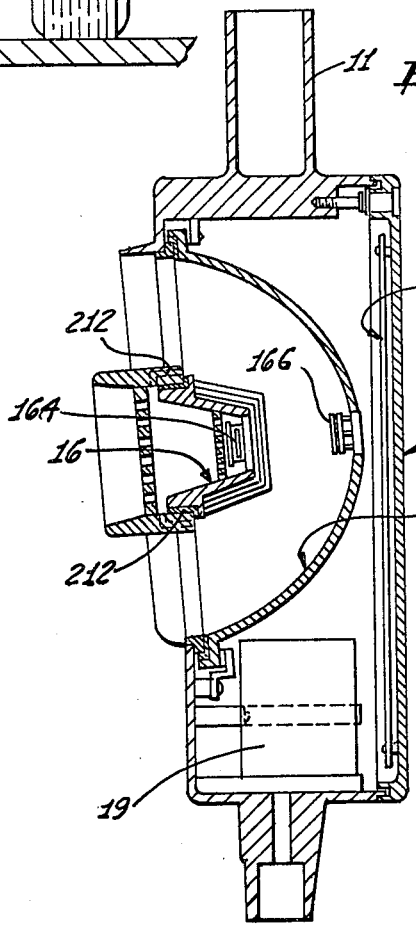
FIG. 3 is a section of a control unit taken along the line 3—3 of FIG. 2, and on a somewhat enlarged scale with respect thereto.

A block diagram of the electronic circuitry and components which are mounted on the circuit board 18 in FIG. 3 is illustrated in FIG. 12. The electronic system of FIG. 12 includes a timer 150 which is energized by the battery 19 when the switches 73 and 101 close, indicating that the associated meter has been wound to initiate a timing interval. The timer sequentially energizes an oscillator 152, a transmitter 154, an input attenuator 156, a receiver 158, a detector 160 and a NAND circuit 162. The NAND circuit, in turn, energizes the solenoids No. 1 and No. 2.

Figure 13:
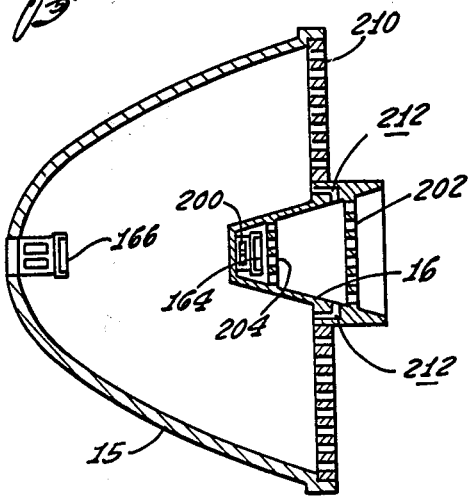
FIG. 13 is a section of transmitter-reciever transducer and reflector members constructed in accordance with the invention so as to prevent blocking of the unit in an attempt to provide false "no-echo" indications.

When the transmitter 154 is energized, it applies an exciting signal to an ultrasonic transducer 164. The transducer 164 may, for example, be a ceramic wafer, or other appropriate material which establishes ultrasonic vibrations when excited in an electrical signal. The transducer 164 may be mounted in the manner shown in FIGS. 14A or 14B, and it is enclosed in the transmitter reflector housing 16. Therefore, when the transducer 164 is excited, it causes ultrasonic waves to be emitted through the mouth of the housing 16. As shown in FIGS. 3, 12 and 13, the transmitter reflector housing 16 is mounted within the receiver reflector housing 15, the latter having, for example, a general parabolic shaped, so that when the ultrasonic vibrations from the housing 16 are reflected, for example, by the motor vehicle 12 of FIG. 1, they are received by the reflector 15 and reflected to a focal point, at which a receiver transducer 166 is located.

The receiver transducer 166 may be generally similar to the transmitter transducer, and it may be mounted in generally the same way. The receiver transducer 166, upon receiving the reflected ultrasonic waves, responds thereto and introduces an electrical signal corresponding to the received reflected waves to the receiver 158.

When a coin is placed in the meter head and the meter is wound to initiate a timed interval, the winding of the meter to the position of FIG. 9 closes both the switches 73 and 101, as described above, so that a voltage is applied to the timer 150 from the battery 19. The timer 150 then begins its sequence of applying the battery voltage to the various circuits in the system. The timer first turns both the oscillator 152 and transmitter 154 on, so that the transducer 164 is caused to emit an ultrasonic signal through the mouth of the transmitter reflector housing 16 with maximum intensity. After an interval of, for example, 3 milliseconds, the timer energizes the attenuator 156, so as to reduce the intensity of the ultrasonic signal transmitted through the mouth of the reflector 16, for reasons to be described.

After an additional 2 millisceonds has elasped, for example, the timer causes the receiver 158 and detector 160 to be energized, and this continues, for example, for an interval of an additional 5 milliseconds. Then, the timer causes the NAND circuit 162 to be energized for an additional 3 milliseconds. The timer then de-energizes the system, and repeats the cycle, for example, every 10 seconds. The various times, naturally, are adjustable, by changing the component values in the timer, and the times will be dictated by local street and traffic conditions.

When the timer 150 applies the battery voltage to the oscillator 152 and transmitter 154, the transmitter applies full power to the transducer 164 which may be of the order of 2 watts. The oscillator is tuned to the series-resonant frequency of the transducer 164, since this is the frequency at which the transducer is most efficient at transforming electrical energy to acoustical energy. This frequency, for example, may be of the order of 20 kHz to 40 kHz.

The timer then turns on the attenuator 156 for the remaining on time of the transmitter, and this lowers the transmitter output power to about 10%of its previous value. The reason for this is that a small amount of the transmitted ultrasonic energy is refracted back directly into the receiver 158 from the transducer 166, and unless some provision is made there usually is sufficient refracted energy at its transducer 166 to provide a falso echo indication when the receiver is first turned on. By stepping down the output intensity of the transmitter during the latter part of the transmitter "on time", and just prior to turning on the receiver, the refracted energy is lowered to a level below the normal threshold level which normally gives rise to false echo indications.

The oscillator and transmitter are then turned off and the receiver and detector 158, 160 are turned on immediately thereafter. At this time, a ringing suppressor circuit in the transmitter is also turned on. This circuit essentially supplies a load for the ringing energy in the transmitter transducer 164, in order to damp out the transducer quickly and efficiently. The transmitter transducer 164 has a high quality factor (Q) for efficient operation, and it normally would continue to ring for a period of time after the drive to the transducer has been removed. It is evident that as long as the transducer 164 continues to ring, it continues to transmit an ultrasonic signal. Since the receiver is turned on immediately after the drive to the transmitter is removed, it is essential that the ringing energy of the transducer 164 be quickly damped out, in order to avoid the introduction by it of a false echo indication to the receiver.

If there is an object, such as the motor vehicle 12 in the path of the transmitted ultrasonic signal, the reflected energy will be received by the receiver transducer 166. The parallel resonant frequency of the receiver transducer is matched with the series resonant frequency of the transmitter transducer 164, since this is the frequency at which the receiver transducer 166 is most efficient in transforming the acoustical energy to electrical energy. The electrical output from the transducer 166 is amplified in the receiver 158 and detected in the detector 160. The detector produces a direct-current voltage level at its output which is proportional to the intensity of the reflected ultrasonic signal received by the transducer 166.

The detector and receiver are subsequently turned off, and the NAND circuit 162 is a logic circuit which, when enabled in the absence of a direct current electrical output from the detector 160, energizes the solenoids 1 and 2 to release the coin-blocking mechanism in the meter, as described above, and also to return the meter timing mechanism to zero, as also described. This causes both switches 73 and 101 to be turned off. However, so long as the motor vehicle is in place, and even if the time interval runs out so that the unwound main spring cuases the switch 101 to open, the switch 73 remains closed and the detector 160 produces a direct-current output. When the NAND circuit 162 is enabled under thhese conditions, the solenoids 1 and 2 remain de-energized and the coin blocking mechanism in the meter remains actuated. However, when the motor vehicle is removed, so that there is no output from the detector 160, the next time the NAND circuit 162 is enabled, it causes both the solenoids 1 and 2 to be energized, so as to unblock the coin slots in the meter. Now both switches 73 and 101 are turned off to de-energize the equipment. Howeve, the next time the meter is operated, the switches 101 and 73 close as the main spring is wound, and the control unit is again energized.

The mounting of the transmitter and receiver transducers 164 and 166 in their corresponding reflector housings 15 and 16 is shown, as mentioned above, in FIGS. 3 and 13. The arrangement of FIG. 3 is somewhat different from that of FIG. 13, but functionally the assemblies are the same. As shown, for example, in FIG. 13, the tranmitter transducer 164 is mounted on a mount 200 within the reflector 16 and behind a pair of spaced grills 202 and 204.

Figure 14A:
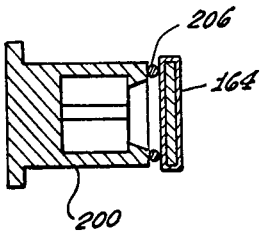
FIGS. 14A and 14B show mounting structures for the transmitter ultrasonic transducer which may, for example, be a ceramic wafer.
Figure 14B:
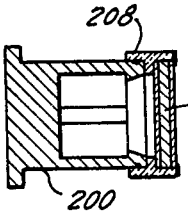

The mount 200 may have the configuration shown, for example, in FIGS. 14A and 14B so as to obviate the build-up of any pressure behind the transducer 164, so that the transducer may vibrate freely in its bending mode for optimum efficiency. The transducer 164 may be mounted on the end of the mount 200, as shown in FIG. 14A by gluing it to an O-ring 206 which, in turn, is glued to the mount 200. Alternately, and as shown in FIG. 14B, the transducer may be retained in a snap-on relationship on the end of the mount by a retainer 208 which may be formed of neoprene rubber, or other appropriate resilient material, and which itself is held on the end of the mount by a snap-on relationship. With the latter construction, the need for adhesively supporting the transducer on the mount is eliminated.

As shown, the transmitter assembly is supported within the mouth of the receiver reflector 15 by means of a grill 210. An important feature of the invention is the provision of bleed holes, apertures or passages, such as the bleed holes 212 from the transmitter reflector housing 16 back into the interior of the receiver reflector housing 15. The illustrated construction of the transmitting and receiving components shown in FIGS. 3 and 13, including the bleed holes 212, is to prevent anyone from attempting to cause the assembly to provide a spurious "non-echo" condition, so as to frustrate the adapter unit of the invention in achieving its intended purpose.

For example, were the transmitter components separate from the receiver components, one could create a spurious "no-echo" situation, merely by holding his hand, or other object, over the mouth of the transmitter reflector 16. However, when that is attempted with the assembly of FIGS. 3 or 13, the signal from the transmitter does pass back through the bleed holes 212, so that the receiver transducer continues to be activated, as in the presence of an actual echo. Moreover, the configuration of the assembly of FIGS. 3 and 13 is such that even though an object is placed very close to the combined mouth of the assembly, it will not tend to block either reflector, and the transmitted ultrasonic energy will continue to be reflected back to the receiver transducer. This, in conjunction with the aforesaid bleed holes, which prevent the trasmitter from being blocked by completely sealing it off from the mouth of its reflector 16, assures that under no conditions can a person cause the apparatus to provide a false "no-echo" indication.

The timer 150 is shown in circuit detail in FIG. 15. As illustrated, the timer includes NPN transistors Q1, Q4, Q6, Q9 and Q12, and PNP transistors Q2, Q3, Q5, Q7, Q8, Q10, Q11 and Q13. When the timer is energized, a 12-volt voltage from the battery 19 is introduced, for example, between the leads 300 and 302. The circuitry associated with the transistors is connected between the leads 300 and 302, as shown in FIG. 15.

The transistors Q1, Q2, and Q3 are connected to a plurality of resistors R1-R7, in the illustrated manner, the resistor R2 being variable. Also, the emitter of the transistor Q1 is connected to a capacitor C1, which, in turn, is connected to the lead 300, whereas the collector of the transistor Q3 is connected to a capacitor C2, which connects with the collector of the transistor Q4. The capacitor C1 may have a capacity of 2.2 microfarads, whereas the capacitor C2 may have a capacity of 0.01 microfarads. The resistor R1 has a resistance, for example, of 8.2 megohms; the resistor R2 has a resistance of 500 kilo-ohms; the resistor R3 has a resistance of 270 kilo-ohms; the resistor R3 has a resistance of 330 kilo-ohms; the resistor R5 has a resistance of 27 kilo-ohms; the resistor R6 has a resistance of 33 kilo-ohms; whereas the resistor R7 has a resistance of 39 kilo-ohms. The collector of the transistor Q3 is connected to a capacitor C5.

It will be appreciated, of course, that the values listed above, and those to be listed subsequently herein, are merely by way of example, and are suitable foruse in the timer circuit, in order to cause it to provide outputs after particular and predetermined time intervals have elapsed from the energizing of the timer.

The transistors Q4, Q5, Q6, Q7 and Q8 are connected to a further group of resistors R8–R21, as illustrated in FIG. 15. The collector of the transistor Q5 is connected to a capacitor C4, the capacitor being connected to the junction of resistors R9 and R11. In addition, the collector of the transistor Q8 is connected through a diode CR1 to a capacitor C6 which, in turn, is connected to the junction of the resistors R15 and R17. Also, the collector of the transistor Q8 is connected to a capacitor C7 which, in turn, is connected to the collector of the transistor Q9.

The capacitors C4 and C6 may each have a value of 0.047 microfarads, and the capacitors C5 and C7 may each have a value of 0.01 microfarads. The resistor R8 may have a value of 22 kilo-ohms, the resistor R9 may have a value of 22 kilo-ohms, the resistor R10 may have a value of 33 kilo-ohms, the resistor R11 may have a value of 2 megohms, the resistor R12 may have a value of 2.7 kilo-ohms, the resistor R13 may have a value of 4.7 kilo-ohms, the resistor R14 may have a value of 15 kilo-ohms, the resistor R15 may have a value of 15 kilo-ohms, the resistor R16 may have a value of 33 kilo-ohms, the resistor R17 may have a value of 2 megohms, the resistor R18 may have a value of 33 kilo-ohms, the resistor R19 may have a value of 1.5 kilo-ohms, the resistor R20 may have a value of 2.7 kilo-ohms, and the resistor R21 may have a value of 470 ohms.

The transistors Q9, Q10, Q11, Q12 and Q13 have a plurality of resistors R22–R38 associated therewith. In addition, the collector of the transistor Q10 is coupled through a diode CR2 to a capacitor C10 which, in turn, is connected to the junction of the resistors R24 and R25; the collector of the transistor Q11 is coupled through a capacitor C8 to the collector of the transistor Q12; and the collector of the transistor Q13 is coupled through a diode CR3 to a capacitor C11 which, in turn, is connected to the junction of the resistors R33 and R34. Also, a capacitor C9 is connected to the emitter of the transistor Q13 and to the common lead 302.

The capacitor C10 may have a value of 0.047 microfarads, the capacitor C11 may have a value of 0.047 microfarads, and the capacitor C9 may have a value of 22 microfarads. The resistor R22 may have a value of 22 kilo-ohms, the resistor R23 may have a value of 10 kilo-ohms, the resistor R24 may have a value of 22 kilo-ohms, the resistor R25 may have a value of 2 megohms, the resistor R26 may have a value of 2.7 kilo-ohms, the resistor R27 may have a value of 4.7 kilo-ohms, the resistor R28 may have a value of 100 kilo-ohms, the resistor R29 may have a value of 47 kilo-ohms, the resistor R30 may have a value of 33 kilo-ohms, the resistor R31 may have a value of 22 kilo-ohms, the resistor R32 may have a value of 33 kilo-ohms, the resistor R33 may have a value of 5.6 kilo-ohms, the resistor R34 may have a value of 2 megohms, the resistor R35 may have a value of 2.7 kilo-ohms, the resistor R36 may have a value of 4.7 kilo-ohms, the resistor R37 may have a value of 27 kilo-ohms, the resistor R38 may have a value of 33 kilo-ohms.

When the exciting voltage is applied to the timer circuit of FIG. 15, the transistors Q1, Q2, and Q3 are initially non-conductive, and the base of the transistors Q1 is biased up to about +7 volts. The emitter of the transistor Q1 is initially at +12 volts due to the capacitor C1 charging current through the resistor R1. As the capacitor C1 charges up, the voltage at the emitter of the transistor Q1 drops until the transistor Q1 begins to become conductive. As the transistor Q1 becomes conductive, it causes the transistor Q2 to become conductive. When the transistor Q2 becomes conductive, the voltage at the junction of the resistors R4 and R5 increases driving the transistor Q1 to a more fully conductive state through the resistor R4.

The aforesaid action is regenerative, and within a few microseconds, the transistors Q1 and Q2 are latched in a conductive condition. The conductive state of the transistor Q2 also causes the transistor Q3 to become conductive. The capacitor C1 then discharges through the resistor R6, through the emitter to base path of the transistor Q2, through the resistor R2, and through the collector-to-emitter path of the transistor Q1. Within a few milliseconds, the capactior C1 has discharged sufficiently, so that the emitter bias on the transistor Q1 rises to a point at which the transistor Q1 tends to become non-conductive. This causes the transistor Q2 to tend to become non-conductive.

The latter action is also regenerative, and in a few microseconds, both the transistors Q1 and Q2 become non-conductive, causing the transistor Q3 to become non-conductive. The sequence then begins again, with the capacitor C1 charging through the resistor R1. The result is a series of pulses which occur each time the transistor Q3 is conductive, and the time between the pulses is determined by the resistance-capacitance time of the resistor R1 and capacitor C1.

The succeeding stages apply the supply voltage to the various parts of the system, and all the stages have the same output of +12 volts. All the stages operate in essentially the same manner, and they vary only in the sequence in which they become conductive, the amount of time in which they remain conductive, and the amount of current they supply. Since the succeeding stages are more or less identical, only the stage consisting of the transistors Q6, Q7 and Q8 will be explained in detail herein.

When the transistors Q3 is conductive, the capacitor C5 has +12 volts applied to both sides, and when the transistor Q3 becomes non-conductive, the capacitor C5 must charge to 12 volts through the resistors R7 and R14, and through the base-to-emitter paths of the transistors Q7 and Q8. The initial pulse of charging current begins to render the transistors Q7 and Q8 conductive. As the transistor Q8 becomes conductive, current begins to flow through the diode CR1, through the resistors R19 and R20, and through the capacitor C6, and resistor R15 into the base of the transistor Q6. The resulting conductive condition of the transistor Q6 draws more current through the resistor R14, and through the transistors Q7 and Q8.

The aforesaid action is regenerative, and in a few microseconds the transistors Q6, Q7 and Q8 are all fully conductive, and latched in the saturated fully conductive condition. The transistor Q8 supplies current to its load which, as shown, are the oscillator 152 and transmitter 154. The transistors Q6, Q7 and Q8 remain conductive as long as current flows through the capacitor C6 and into the base of the transistor Q6. After an interval of about 5 milliseconds for this particular stage, the capacitor C6 has charged sufficiently such that the base current of the transistor Q6 drops, thereby bringing the transistor Q6 out of its saturated condition and lowering the base drive to the transistors Q7 and Q8.

As the transistors Q8 begins to become less conductive, the drive to the transistor Q6 is further lowered, so that a further regenerative action is created, and in a few microseconds the transistors Q6, Q7 and Q8 are all non-conductive. The capacitor C7 then starts the same sequence in the next stage, which is the circuit of the transistors Q9, Q10 and Q11. The diode CR1 prevents the capacitor C6 from discharging back into the load of the transistor Q8 when the transistor Q8 becomes non-conductive, so that the output waveform will maintain a very fast turn-off time.

In the manner described, therefore, the transistor Q5 provides an exciting potential to the transmitter input attenuator 156 of FIG. 16 at the time ($t_1$); the transistor Q8 provides an exciting potential to the transmitter 154 and oscillator 152 at the proper intervals ($t_2$); the transistor Q10 provides an exciting potential to the front end stages of the receiver at time ($t_3$); whereas the transistor Q11 provides an exciting potential for the receiver emitter follower and transmitter ring suppression circuit at the same time ($t'_3$), as mentioned above, and as will be described. Finally, the transistor Q13 provides the desires enabling potential to the NAND circuit 162 at the proper time ($t_4$).

The transmitter circuit 154 of FIG. 16 includes an NPN transistor Q100 which is connected as an oscillator, the oscillator being energized at time $t_2$ when the timer circuit 150 of FIG. 15 produces the exciting voltage to a common lead 400. The base of the transistor Q100 is connected to the junction of a pair of resistors R100 and R102, the resistors being connected between the lead 400 and a common return lead 402. The resistor R100 may have a resistance of 82 kilo-ohms, and the resistor 102 may have a resistance of 39 kilo-ohms. The emitter of the transistor Q100 is connected to a resistor R103 and to a capacitor C104, both of which are connected to the common lead 402. The resistor R103 may have a resistance of 3.3 kilo-ohms, and the capacitor C104 may have a capacitance of 0.01 microfarads.

A pair of capacitors C100 and C103 are connected between the lead 400 and the capacitor C104. The common junction of the capacitors C100 and C103 is connected to the collector of the transistor Q100 and to a capacitor C102. The collector of the transistor Q100 is also connected to a variable inductor L100, to the lead 400, and the capacitor C102 is connected to a resistor R107 and to the source electrode of a field effect transistor Q102. The capacitors C102, C103, and C104 may each have a capacitance of 0.01 microfarads, whereas the capacitor C11 may have a capacity of 0.0033 microfarads. The resistor R107 may have a resistance of 1 megohm.

The drain electrode of the transistor Q102 is connected through a resistor R110 to the junction of a resistor R109 and capacitor C105. The resistor R109 may have a resistance of 100 kilo-ohms, and the resistor R110 may have a resistance of 10 kilo-ohms. The gas electrode of the field effect transistor Q102 is connected to a capacitor C110 which, in turn is connected to the common lead 402. The timer 105 produces an energizing voltage at the gate electrode of the field effect transistor Q102 at the time $t_1$. A resistor R118 is included in the connection between the transistor Q102 and the capacitor C110. This resistor may have a resistance of 100 kilo-ohms.

The capacitor C105 is connected to one of the inputs of an integrated circuit element AR1. This integrated circuit element may be of the type designated CA30-20A and sold by the Radio Corporation of America. The other input terminal of the integrated circuit AR1 is connected to a resistor R112 of, for example, 5.1 kilo-ohms, the resistor being connected to the common lead 402. The circuit of the field effect transistor Q102 functions as the attenuator 156, and the circuit of the transistor Q100 functions as the oscillator 152 of FIG. 12.

The output of the integrated circuit AR1 is connected to the primary of a transformer T100 through a usual network, the secondary of which is connected to the transducer 164. A switching transistor Q104 is included in the latter circuit, and this transistor is energized by the timer 150 of FIG. 15 at time $t'_3$, so that its circuit may function as the aforesaid ring suppressor and suppress ringing in the circuit from the transducer 164. The energizing current from the timer 150 is applied to the base of the transistor Q104 at $t'_3$ time, and through a resistor R115 of, for example, 33 kilo-ohms. The base of the transistor Q104 is also connected to a resistor R116, and its collector is connected through a resistor R117 to the center tap of the primary of the transformer T100. The resistor R116 may have a resistance of 2.7 kilo-ohms, and the resistor R117 may have a resistance of 100 ohms.

The oscillator circuit of the transistor Q100 is a standard transistor oscillator, the frequency of which is established by the tuned circuit L100 and C100, C103 and C104 in its collector. This tuned circuit is adjustable, for example, in a frequency range of approximately 20 kilocycles to 45 kilocycles by means of the variable inductance coil L100.

The circuit of the field effect transistor Q102 serves as the input amplitude attenuator 156, as explained above. The field effect transistor Q102 is an N channel depletion mode field effect transistor. When $t_2$ is established at the 12-volt level by the timer 150, and when $t_1$ is also at the 12-volt level, the transistor Q102 is rendered conductive, and the input signal is attenuated by the parallel combination of the resistors R109 and R110. However, when the voltage at $t_1$ of the timer 150 goes to zero, the field effect transistor Q102 is rendered non-conductive, and the input is attenuated by the high impedance of the resistor R109 only, so that the input to the transmitter is lowered at the time $t_2$, so that the output from the transmitter is reduced at that time, as is desired, for the reasons explained above.

The element AR1 is an integrated circuit amplifier, and is a Class B amplifier with a power gain of approximately 75 db. The integrated circuit AR1 amplifies the attenuated oscillator signal and applies it to the transmitting transducer 164 through the transformer T100. Zener diode ZN1 is used to lower the +12 volt to a +9 volt level required by AR1.

The transistor Q104, and its associated components, including the diodes CR100 and CR102 form a circuit which functions rapidly to damp out the ringing of the transmitting transducer 164 immediately after the transmitter has been turned off. When the voltage at the output terminal $t_2$ of the timer 150 goes to zero volts, the voltage at the output terminal $t'_3$ immediately rises to the 12-volt level, and causes the transistor Q104 to connect the center tap of the primary of the transformer T100 to the common lead 402 through the resistor R117. As the transducer 164 rings mechanically, its mechanical energy is transformed into a voltage across the transducer and across the secondary of the transformer T100. The resulting energy in the primary circuit is quickly dissipated by the resistor R117 and through the diodes CR101, and CR102, and the conductive transistor Q104.

The receiver circuit as shown in FIG. 17 has its input terminals connected to the receiver transducer 166 of FIG. 12, one of the input terminals being connected to the gate electrode of a field effect transistor Q201. The source electrode of the field effect transistor Q201 is connected to a 15 kilo-ohmn resistor R200 which, in turn, is connected to the common lead 500 of the circuit. The resistor R200 is shunted by a 0.002 microfarad capacitor C202. The gate electrode of the transistor Q201 is connected to a 2 megohm resistor R202 which also is connected to the common lead 500. The drain electrode of the transistor Q201 is connected to a 5.6 kilo-ohm resistor R203 and to a coupling capacitor C201. The resistor R203 is connected to the $t_3$ output terminal of the timer 150 in FIG. 15, so that the circuit of the field effect transistor Q201 is energized at $t_3$ time by the timer when that output terminal goes to +12 volts.

The output from the field effect transistor Q102 is amplified by a plurality of usual cascaded transistor amplifiers including the transistors Q202, Q203, Q204, and Q205. These stages may be essentially identical, and need not be described in detail. The output from the final amplifier transistor Q205 is coupled to the base of an NPN transistor Q206 which, in turn, is connected to an NPN transistor Q207. The transistor Q207 is connected as an emitter follower, its emitter being connected to a resistor R204 is connected to the common terminal 500.

The transistors Q206 and Q207 are energized at $t'_3$ time by the timer 150 of FIG. 15, when its output terminal $t'_3$ rises to +12 volts. When that occurs, the amplified output from the preceding stages is applied to the detector circuit formed by the transistor Q208 and the diodes CR201 and CR202. This produces a direct-current voltage across the capacitor C206, which capacitor has a value of, for example, 1 microfarad. The emitter of the transistor Q207 is coupled to the detector through a capacitor C205 likewise having a capacity of 1 microfarad. The base of the transistor Q208 is connected to a 0.012 microfarad capacitor C208 which, in turn, is connected to the terminal $t'_3$ of the timer through a 22 kilo-ohm resistor R206.

The NAND gate circuit 162 includes a silicon controlled switch CR203, and the voltage across the capacitor C206 is introduced through an NPN transistor Q209 to the gate electrode of the silicon controlled switch. The collector of the transistor Q209 is connected to the gate electrode of he silicon controlled rectifier switch, and also to the output terminal $t_4$ of the timer circuit through a resistor R210 of, for example, 39 kilo-ohms. The anode of the silicon controlled switch CR203 is connected through the coils of the solenoid 1 and solenoid 2 to the +12 volt terminal of the battery 19.

The further electrode of the silicon controlled switch CR203 is connected to the 12-volt terminal through a 3.3. kilo-ohm resistor R212. The collector of the transistor Q209 is also connected to a capacitor C207 which, in turn, is connected to the common lead 500. A pair of resistors R222 and R224 are connected across the capacitor C206, the resistor R222 having a resistance of 68 kilo-ohms, and the resistor R224 having a resistance of 330 kilo-ohms. The junction of these resistors is connected to the base of the transistor Q209, and to a resistor R226. The latter resistor has a value for example, of 270 kilo-ohms, and is coupled through a 1 microfarad capacitor C210 to the 12-volt terminal of the battery 19.

As mentioned above, the receiver of FIG. 17 includes a series of conventional transistor amplifier stages connected in cascade, and giving an overall voltage gain, for example, of 70 db. The first stage of the amplifier is a high input impedance common source field effect transistor circuit, formed by the transistor Q201, and which has an alternating-current gain of approximately 5. The next four stages are connected as conventional common emitter stages with a gain of approximately 5. The second stage of the five includes a capacitor C212 in the emitter circuit of the transistor Q202, and it includes a capacitor C213 in the collector circuit.

The value of the capacitor C212 may, for example, be of the order of 3300 picofarads, whereas the value of the equivalent capacitors in the succeeding amplifier stages may be of the value of 0.01 microfarads. The value of the capacitor C213 may be .001 microfarads. The capacitor C212 in the emitter circuit of the transistor Q202 serves as a compensating capacitor to lower the gain of the overall amplifier below 20 kHz, and the capacitor C213 in the collector circuit serves to lower the gain above 40 kHz. The two networks cooperate so as to lower the noise bandwith of the amplifier, and cause the receiver to be more selective. This compensation also prevents the amplification of high frequency oscillations due to stray capacitance and common power supply feedback.

The sixth stage, formed by the transistors Q206 and Q207 is a Darlington-connected emitter follower circuit with a gain of 1. The purpose of this circuit is to provide an impedance transformation from the high impedance of the amplifier to the low impedance required by the detector circuit. The detector 160 is a half wave detector comprising the diodes CR201 and CR202, with the resulting DC voltage appearing across the capacitor C206. The capacitor C206 is charged to the peak value of the output waveform less the voltage drop across the diode CR201.

The circuit of the transistor Q208 serves to inhibit the detector by shorting the junction of the diodes CR201 and CR202. This occurs at the time $t_3$, and when the corresponding output terminal of the timer 150 rises to the 12-volt level. The capacitor C206 is thereby prevented from being charged up while the emitter follower circuit of the transistors Q206 and Q207 is being energized. Without the circuit of the transistor Q208, the detector capacitor C206 would be charged up as the emitter of the emitter follower transistor Q207 rises to its normal direct-current level, which would thereby provide a fasle detector output.

The circuit of the transistor Q209 and of the silicon controlled switch CR203 constitute the NAND gate circuit 162, as explained above. When the receiver has a signal present in it from the transducer 166, and which signal is sufficient to cause the capacitor C206 to be charged above a predetermined threshold level, and when the output terminal $t_4$ of the timer rises to its 12-volt level, the resulting conductivity of the transistor Q209 effectively shorts out the gate electrode of the silicon control switch CR203, so that the switch remains non-conductive, and the solenoids 1 and 2 remain de-energized.

However, when no signal is present in the receiver, and when $t_4$ rises to its 12-volt level, the transistor Q209 is non-conductive, so that current is now conducted into the gate electrode of the silicon controlled switch CR203 causing the switch to turn on, and thereby energize the solenoids 1 and 2. When these solenoids are energized, and as explained above, the unused time in the meter is wiped off, and the coin slots are unblocked. The capacitor C210 and resistor R226 in the circuit of the transistor Q209 serve to prevent the silicon controlled switch CR203 from triggering when the +12 volts is first applied to the system, which occurs when a coin is inserted into the meter and the meter is wound to the interval commencing position. The capacitor C210 and resistor R226 apply current to the transistor Q209 during that time to maintain the transistor conductive, so that the silicon controlled switch CR203 is not fired.

It will be understood, of course, that the circuits of FIGS. 15, 16 and 17, and the values of the components in the several circuits, are given merely by way of example, and are not intended to limit the invention in any way. It should be apparent that other circuits may be used in order to achieve the desired control effects of the system and apparatus of the invention.

Figure 20:
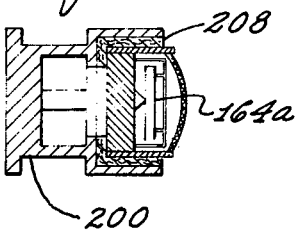
FIG. 20 is a section of a mounting structure like FIG. 14B, but modified in certain aspects.

The transducer assembly 164*a* of FIG. 20 is somewhat different from the assembly shown in FIG. 14B, but it operates in essentially the same manner. The transducer assembly 164a is advantageous in that transducers of the type shown, which operate satisfactorily over the wide humidity and temperature ranges encountered by parking meters, are economically, commercially available. The transducer 164*a* is mounted on the mount 200 by an appropriate retainer 208*a*.

Figure 19:
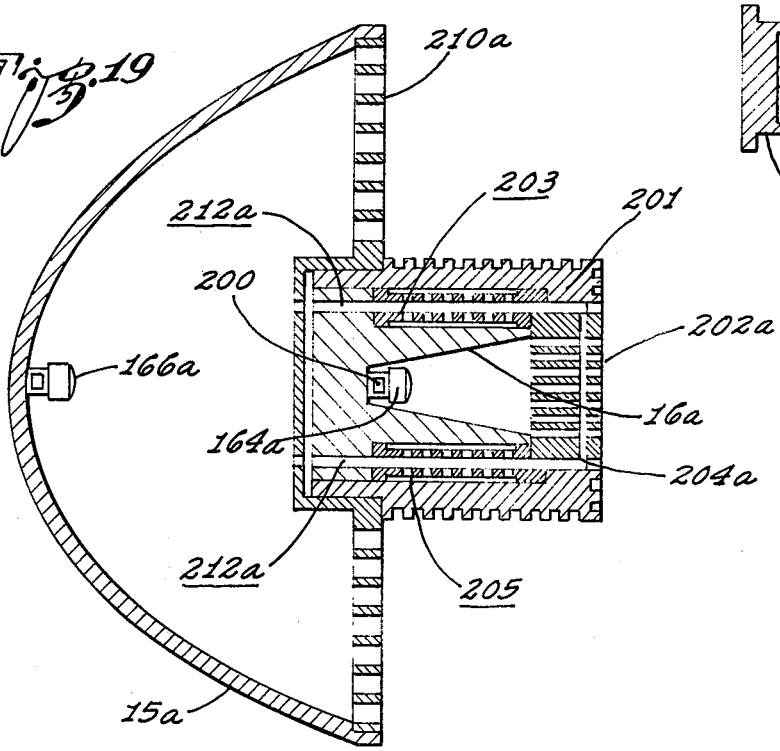
FIG. 19 is a section like FIG. 13, but modified in certain structural aspects.

The receiver transducer 166*a* is mounted in a reflector housing 15*a* in FIG. 19, which is similar to the reflector housing 15 of FIG. 13, the forward end of which is enclosed by a grille 210*a* which is generally similar to the grille 210 of FIG. 13. The transmitter transducer 164A is mounted in a reflector housing 16*a* in FIG. 19 which has certain dissimilarities, as compared with the housing 16 of FIG. 13.

In the embodiment of FIG. 19, the reflector housing 16*a* is surrounded by an outer tubular housing 201 which is coaxial with the reflector housing 16*a*, and which defines passageways 212*a* that serve the previously described bleed function. The passageways extend from the transmitter reflector housing 16*a* back into the interior of the receiver reflector housing 15*a*. A grille 202*a* is mounted across the front of the housing 201, and a grille 204*a* is mounted across the front of the reflector housing 16a and spaced from the grille 202*a*, the grilles 202*a* and 204*a* constituting an equivalent structure to the grille 202 and 204 in the embodiment of FIG. 13.

The tubular housing 201 has external notches, as shown, which serve to inhibit sound refraction along its surface thereby preventing false echos back into the receiver. The sound refraction problem is further inhibited by a pair of coaxial perforated tubular members 203 and 205, one of which is mounted on the external surface of the reflector housing 16*a*, as shown, and the other of which is mounted on the inner surface of the housing 201, as also shown. These perforated tubular members may be formed of aluminum, or other appropriate material, and as mentioned they function as silencers further to inhibit false echos back to the receiver transducer 166*a*.

In the embodiment of FIG. 19, the reflector housing 16b is surrounded by an outer tubular housing 201*b* which is coaxial with the housing 16*b*, and which defines passageways 212*b* which serve the previously defined bleed function. The passageways 212*b* extend back into the interior of the receiver reflector housing 15*a*. *In the embodiment of FIG. 19A, the grille 202a* of FIG. 19 is eliminated, and only the grille 204*b* mounted across the front of the reflector housing 16*b* is retained. The elimination of the grille 202*a* lessens the attenuation of the transmitted signal, as compared with the embodiment of FIG. 19.

Figure 19A:
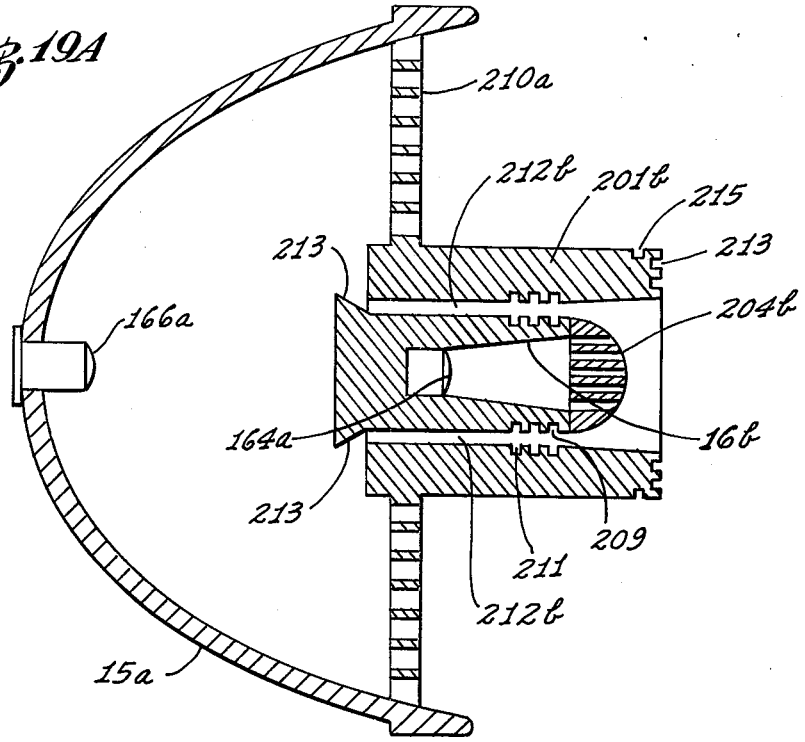
FIG. 19A is a section like FIG. 13, but modified in further certain structural aspects.

The tubular members 203 and 205 of the previous embodiment are eliminated in the embodiment of FIG. 19A, and peripheral notches 209 are formed around the periphery of the housing 16*b*, and further notches 211 are formed around the bore of the housing 201, and these latter notches function as silencers to inhibit false echos back to the receiver transducer 116*a*. Additional notches 213 are provided on the front of the housing 201*b* and a further external notch 215 is provided, further to inhibit false echos.

It will be noted that the housing 212*b* in the embodiment of FIG. 19A has an inclined portion 213 at its rear end. This inclined portion serves to direct signals received through the bleed passages 212*b* against the reflector 15*a*, so that these signals will be directed to the receiver transducer 116*a*. In this way, should the front of the housing 201*b* become blocked, the signals fed back through the bleed passages 212*b* will reach the receiver transducer 116*a* with minimum attenuation.

Figure 19B:
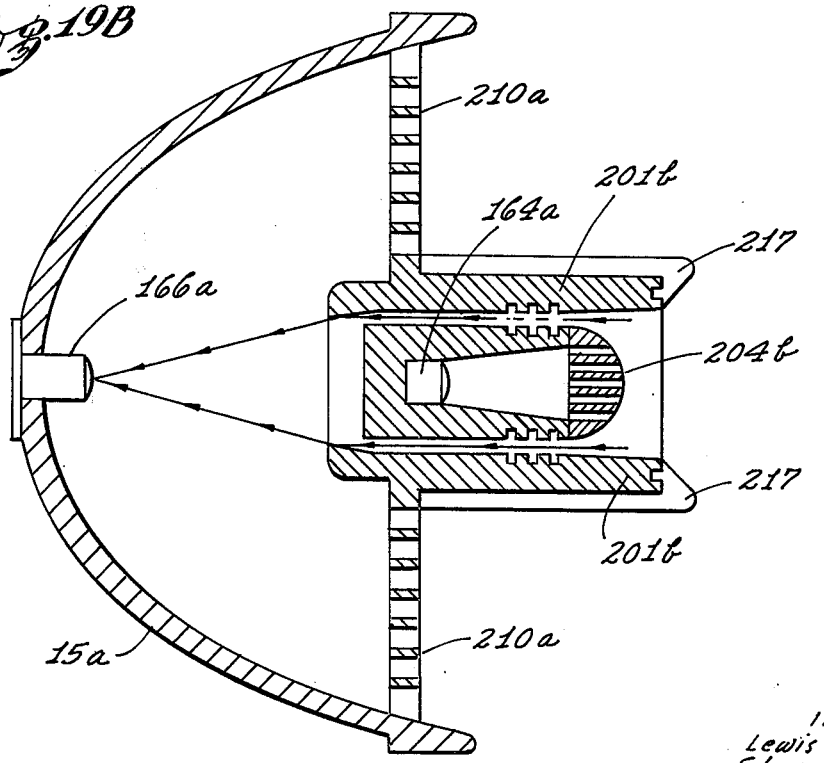
FIG. 19B is another section like FIG. 13, and also modified in accordance with certain structural aspects.

The embodiment of FIG. 19B is generally similar to the embodiment of FIG. 19A, and like components have been designated by the same numbers. In the latter embodiment, a series of longitudinal fins 217 are mounted on the external surface of the housing 201*b*, and these fins extend beyond the front of the housing 210*b*. The purpose of these fins is to provide additional bleed passages back to the receiver transducer 116*a*, in the event that an attempt is made to block the front of the housing 201*b*.

It should be noted in the embodiment of FIG. 19B that the rear end of the housing 201*b* is shaped to direct the bleed signals directly to the transducer 166*a*, instead of along a reflected path, as was the case with the embodiment of FIG. 19A.

The circuitry of FIGS. 21, 22 and 23 is generally similar to the corresponding circuits of FIGS. 15, 16 and 17, and like elements have been designated by the same numbers. Certain improvements have been incorporated into the circuits of FIGS. 21, 22 and 23, however, as will now be described.

For example, in the timer circuit of FIG. 21 the circuit is modified so that the time intervals $t_3$ and $t'_3$ both start at the end of the time interval $t_1$, rather than at the end of the time interval $t_2$, as was the case in the previous embodiment. This allows the receiver to recover from any transients induced due to receiver turn on, and to reach steady state operation prior to the turn off of the transmitter. The aforesaid changes are implemented by the inclusion of the diode CR4 in the collector circuit of the transistor Q5, and by connecting the $t_1$ terminal between the diode and the collector, and moving C7 from the junction of Q8 collector and CR1 to the junction of Q5 collector and CR4.

The timer circuit of FIG. 21 also includes a transistor Q14 connected in circuit with the transistors Q9 and Q11, as shown, which, in conjunction with resistors R40 and R39, provide temperature compensation for the timer circuit.

Figure 18:
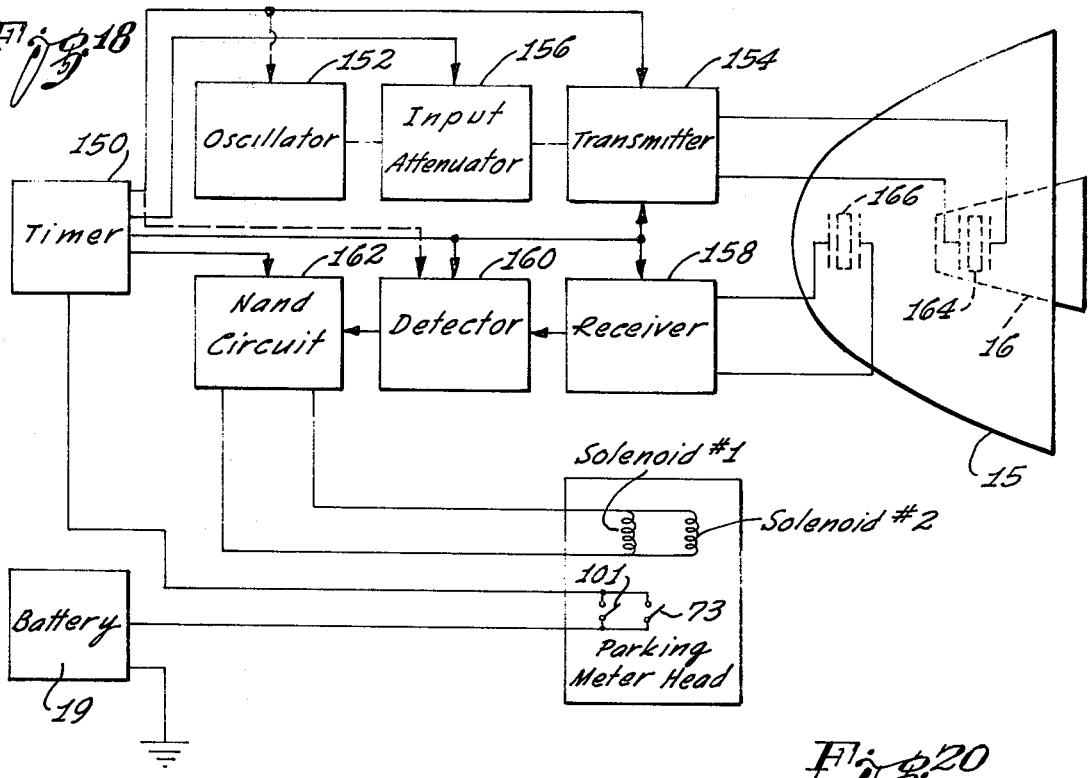
FIG. 18 is a block diagram like FIG. 12, but illustrating a modification in accordance with a further embodiment of the invention.

As shown in the block diagram of FIG. 18, part of the detector 160 is also energized when the transmitter and its associated components are energized. This inhibits the detector during this time to prevent a false echo indication while the transmitter is on.

The modified transmitter circuit is shown in FIG. 22, and, as mentioned above, the circuit is generally similar to the circuit of FIG. 16. In the latter circuit, the fixed inductance coil L101 replaces the variable inductance coil L100 of the previous circuit. The circuit of FIG. 22 is tuned by a capacitor C111 which is shunted by a trimming capacitor C112. The circuit of the field effect transistor Q102 has been modified slightly in the circuit of FIG. 22 for improved operation, the resistors R120, R121 and R122 being included in the circuit. The field effect transistor Q102 still functions as the input attenuator 156 and it still serves to allow the oscillator signal to be attenuated either through two resistors or one.

The ring suppressor circuit of the transistor Q104 has been changed slightly, and it serves to short circuit the secondary rather than the primary of the transformer T100 for improved results.

The receiver circuit of FIG. 23 has been changed slightly so that the detector 160 (FIG. 18), as formed by the circuit of the diodes CR201 and CR202 may be inhibited during the time interval $t_2$, this being achieved by the transistor Q208 and its associated resistors R228 and R229 and diode CR204.

While particular embodiments of the invention have been shown and described, modifications may be made, and it is intended to cover all such modifications in the claims.

What is claimed is:

1. An adapter unit for use with a standard parking meter for introducing a control effect into said meter, said meter including a timing mechanism, and coin-controlled means for setting said timing mechanism to the commencement of a predetermined time interval; said adapter including: ultrasonic electrical detector means for sensing the presence of a vehicle adjacent said parking meter, and control means coupled to said ultrasonic detection means and activated thereby to introduce the aforesaid control effect into said meter, in which said ultrasonic electrical detection means includes a receiving reflector member, a receiving electrical-acoustical transducer mounted within said receiving reflector member, a transmitting reflector member mounted at the mouth of said receiving reflector member, and a transmitting electrical-mechanical transducer mounted within said transmitting reflector member.

2. The combination defined in claim 1, and which includes transmitting electronic circuitry coupled to said transmitting transducer, and receiving electronic circuitry coupled to said receiving transducer, and timing means controlling the energization of said transmitting circuitry and receiving circuitry so that said detection means senses objects only within certain predetermined distances from the adaptor unit.

3. The combination defined in claim 2, and which includes attenuator means included in said transmitting circuitry and coupled to said timing means to reduce the amplitude of the transmitted ultrasonic signal at predetermined intervals just prior to activating said receiving circuitry to prevent false echo indications in said receiving circuitry from refracted energy from said transmitting circuitry.

4. The combination defined in claim 2, and which includes a damper circuit included in said transmitting circuitry, and controlled by said timing means for dissipating ringing energy from said transmitting transducer at the termination of a transmitting interval.

5. The combination defined in claim 4, in which said transmitting reflector member defines an auxiliary path into the interior of said receiving reflector member, for producing a signal at said receiving transducer even in the presence of a blocking means at the mouth of said transmitting reflector member.

6. The combination defined in claim 5, in which said transmitting reflector member has at least one aperture therein extending into the interior of said receiving reflector member to define the aforesaid auxiliary path.

7. The combination defined in claim 6, and which includes a mount for at least one of said transducers for vibration in the bending mode with a minimum of back pressure, and which includes a resilient annular member frictionally coupled to the end of said mounting means and to said transducer for supporting said transducer on said mounting means.

8. The combination defined in claim 1, and which includes a tubular member mounted coaxially with respect to said transmitter reflector member, and a pair of perforated tubular members mounted respectively on the outer surface of said transmitter reflector member and on the inner surface of said tubular member in coaxial relationship and serving to inhibit false echos from said transmitting transducer to said receiver transducer.

9. The combination defined in claim 8, in which said tubular member has notches formed on the external surface thereof to inhibit sound refraction along said surface.

10. The combination defined in claim 1, and which includes a tubular member mounted coaxially with respect to said transmitter reflector member and defining therewith bleed passages back to said receiver transducer.

11. The combination defined in claim 10, in which said transmitter reflector member is shaped to direct bleed signals with minimum attenuation back to said receiver transducer.

12. The combination defined in claim 10, and which includes a plurality of longitudinally extending external fins disposed around the outer surface of said tubular member and extending beyond the forward end of said tubular member, said fins providing additional paths for bleed signals back to said receiver transducer.

13. A parking meter controller for connection to a parking meter adjacent a space occupiable by a vehicle, said meter having a member movable from a timing position to a time expired position, said parking meter controller comprising:

a switch movable to an actuated position when the movable member in the parking meter is in a timing position;

reset means actuatable to permit the movable member to move from its timing position to its time-expired position; and sonic sensing means in said parking meter controller, said sonic sensing means being directed horizontally toward said space, said sonic sensing means being connected to be energized by actuation of said switch for sonically determining the presence of a vehicle adjacent said parking meter controller and occupying said space, said sonic sensing means being connected to said reset means so that, upon determination by said sonic sensing means of the absence of a vehicle adjacent said parking meter controller, said reset means is actuated to permit the movable member to move to its time-expired position.

14. The parking meter controller of claim 13 wherein said sonic sensing means comprises transmitter means and receiver means, said transmitter means and said receiver means being energized only when said switch is actuated.

15. The parking meter controller of claim 14 wherein logic means is connected to said transmitter means and to said receiver means, said logic means periodically actuating said receiver means and periodically actuating said transmitter means while said receiver means is actuated.

16. The parking meter controller of claim 15 wherein said receiver means is connected to said reset means so that said reset means is actuated after said receiver means fails to receive a reflected sonic signal.

17. The parking meter controller of claim 13 wherein said controller is mounted in a controller housing, said controller housing being mountable upon the post of a standard parking meter adjacent the standard parking meter.

18. The parking meter controller of claim 17 wherein a controller bracket is mountable within said standard parking meter, said controller bracket carrying said switch means and said reset means.

19. The parking meter controller of claim 17 wherein said controller sonic means includes separate transmitter means and receiver means, said transmitter means periodically emitting sonic bursts when said switch is actuated by said movable member.

20. The parking meter controller of claim 19 wherein logic means is connected to periodically turn on said receiver during the period when said switch is actuated and to periodically cause said transmitter means to emit bursts of sonic energy while said receiver means is energized.

21. The parking meter controller of claim 20 wherein said receiver is connected to said reset means to actuate said reset means after said receiver means fails to receive the echo of a plurality of sonic bursts emitted by said transmitter means.

22. An adapter unit for use with a standard parking meter for introducing a control effect into said meter, said meter including a timing mechanism, and coin-controlled means for setting the timing mechanism to the commencement of a predetermined time interval; said adapter unit including: detection means for sensing the presence of a vehicle adjacent said parking meter; a shield movable between a coin-blocking and a coin-unblocking position with respect to said coin-controlled means, control means coupled to said detection means and activated thereby to cause said shield to move to said coin-blocking position at the setting of said timing mechanism to prevent further coins from being inserted into said meter so long as the aforesaid vehicle remains adjacent thereto; and so that said coin-blocking may be pre-adjusted to block further coin insertion after an adjustable, predetermined amount of parking time has been purchased.

* * * * *

UNITED STATES PATENT OFFICE

CERTIFICATE OF CORRECTION

Patent No. 3,999,372 Dated December 28, 1976

Inventor(s) Lewis W. Welch et al.

It is certified that error appears in the above-identified patent and that said Letters Patent are hereby corrected as shown below:

Column 1, line 7, "1976" should read -- 1969 --.

Signed and Sealed this

Nineteenth Day of April 1977

[SEAL]

*Attest:*

RUTH C. MASON
*Attesting Officer*

C. MARSHALL DANN
*Commissioner of Patents and Trademarks*